United States Patent [19]

Osada et al.

[11] Patent Number: 4,854,529

[45] Date of Patent: Aug. 8, 1989

[54] VEHICLE CONTROL SYSTEM HAVING TWO TRACKSIDE SIGNAL LINES

[75] Inventors: Shuichi Osada; Satoru Hayashi; Masaru Goto; Kiyoshi Godo, all of Hyogo, Japan

[73] Assignee: Tsubakimoto Chain Co., Japan

[21] Appl. No.: 178,239

[22] Filed: Apr. 6, 1988

[30] Foreign Application Priority Data

Apr. 10, 1987 [JP] Japan ..... 62-55304[U]
May 29, 1987 [JP] Japan ..... 62-85063[U]

[51] Int. Cl.[4] ..... G05D 13/00

[52] U.S. Cl. ..... 246/187 B; 246/182 R; 104/295

[58] Field of Search ..... 104/295, 298, 300; 246/182 C, 187 B, 122 R, 64, 66, 182 R, 187 R

[56] References Cited

U.S. PATENT DOCUMENTS

| | | | |
|---|---|---|---|
| 1,195,748 | 8/1916 | Sutphin | 246/64 |
| 3,582,971 | 6/1971 | Coccia | 246/182 R X |
| 3,710,100 | 1/1973 | Perry | 246/187 B X |
| 4,166,599 | 9/1979 | Auer, Jr. et al. | 246/187 B X |
| 4,330,830 | 5/1982 | Perry | 246/182 C |

FOREIGN PATENT DOCUMENTS

| | | | |
|---|---|---|---|
| 2562018 | 10/1985 | France | 246/187 B |
| 1407970 | 10/1975 | United Kingdom | 246/182 C |

*Primary Examiner*—Robert B. Reeves
*Assistant Examiner*—Gary C. Hoge
*Attorney, Agent, or Firm*—Darby & Darby

[57] ABSTRACT

A vehicle control system in accordance with the present invention permits a vehicle to move only in the case where both of a device for detecting the content of a signal for directing the travelling speed of the vehicle transmitted from the trackside and a device for detecting the presence of the above signal perform detecting operations. The apparatus also comprises a device for detecting an abnormal operation of both the above mentioned devices, so that a runaway of the vehicle can be avoided. In addition, a voltage signal can be used for detecting the speed, and the vehicle can be controlled by means of a set of two signal lines, resulting in a reduction in the amount of equipment.

10 Claims, 7 Drawing Sheets

VEHICLE CONTROL SYSTEM HAVING TWO TRACKSIDE SIGNAL LINES

BACKGROUND OF THE INVENTION

1. Field of the Invention

This invention relates to an apparatus for controlling travelling of a vehicle by transmitting signals to the vehicle travelling on a track by means of signal lines disposed along the track.

2. Description of the Prior Art

In vehicle travelling apparatus of this kind, it is desired to make a diversity of travelling control of a vehicle possible by means of a small number of signal lines.

In conventional vehicle travelling apparatus of this type, for example, as shown in the Japanese patent publication No. 56-21627 (1981), a speed command signal for commanding the travelling speed of a vehicle is coded and transmitted to the vehicle by wireless (radio) control, and thereby the travelling of the vehicle is controlled. Also, apart from the above-described control, three or four signal lines are installed on or near the track on which the vehicle travels and the speed command signal is transmitted from these signal lines to the vehicle and thereby the vehicle is controlled for its travelling.

However, in the above-described conventional technology, the speed command signal is required to be coded, and therefore a problem occurs in that a circuit configuration of a transmitting unit for outputting the speed command signal becomes complicated, and accordingly the whole apparatus becomes expensive.

Also, another problem occurs that, in the case where the vehicle receives a signal different from the original speed command signal due to effect of external noise, the vehicle suddenly starts or stops, or further travels at an unexpected speed.

Furthermore, three or four signal lines are required to be disposed along the track, and therefore a disadvantage exists in cost.

SUMMARY OF THE INVENTION

The present invention has been achieved in light of such circumstances.

In a vehicle travelling apparatus in accordance with the present invention, a configuration is adopted wherein a vehicle is controlled with signals provided from only a set of two signal lines. One line provides a non-coded signal to command the vehicle speed on the other. The vehicle has a speed signal detection unit for discriminating the speed command signal and a travelling signal detection unit for detecting the presence of the speed command signal. The vehicle also has an abnormality detection unit for detecting an abnormal controlling operation of the speed signal detection unit or the travelling signal detection unit and when detecting an abnormal state, the vehicle is stopped.

The above and further objects and features of the invention will more fully be apparent from the following detailed description and the accompanying drawings.

DESCRIPTION OF THE PREFERRED EMBODIMENT

Hereinafter, detailed description is made of the present invention based on drawings showing a preferred embodiment thereof.

The vehicle travelling apparatus of this kind is used, for example, for automatically transferring in-factory articles such as assemblies to a desired manufacturing process location in the factory. For this purpose, it is configured in a manner that an elevated track (not shown) is installed whereon a vehicle travels, signal lines are installed along this track to provide control signals to the vehicle travelling on the track, the travelling of the vehicle being controlled based on those signals.

Figure 1:
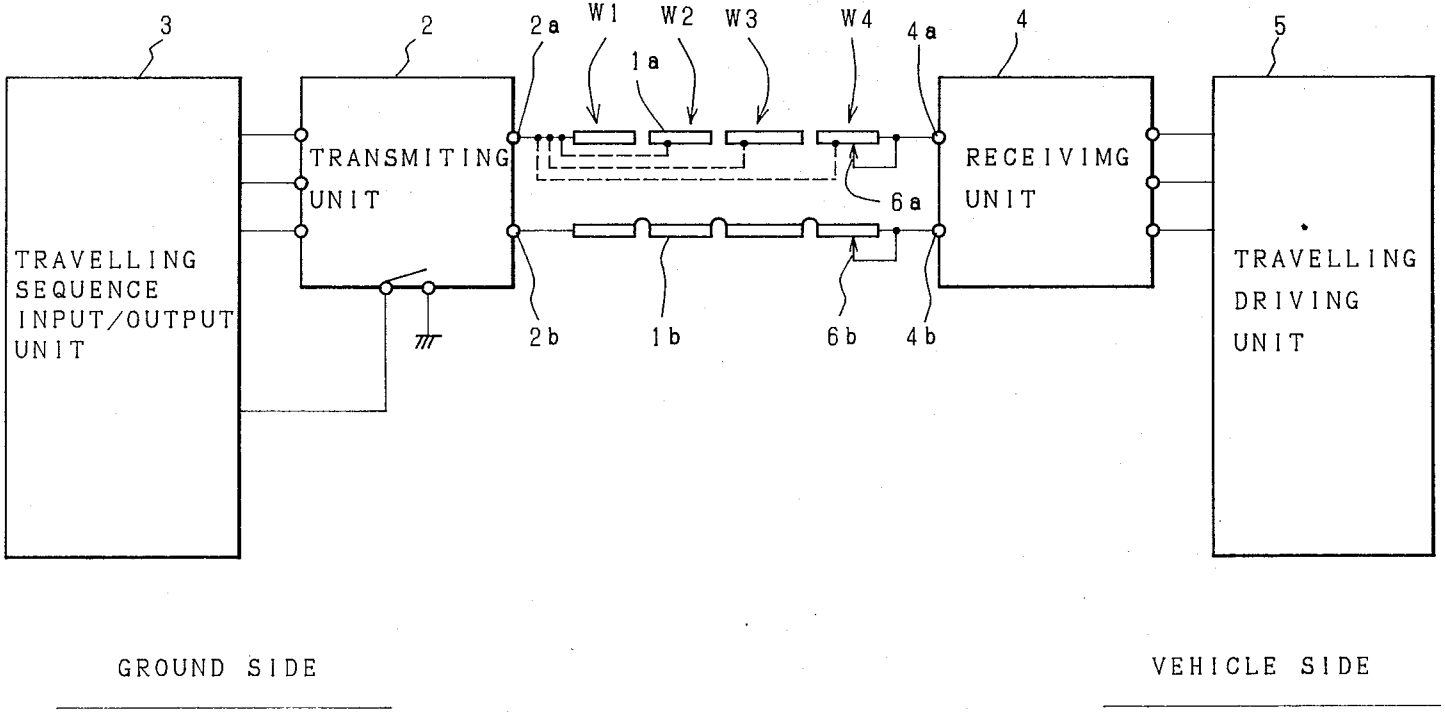
FIG. 1 is a schematic block diagram of a vehicle travelling apparatus in accordance with the present invention.

FIG. 1 is a block diagram showing a schematic configuration of a vehicle travelling apparatus in accordance with the present invention.

Two signal lines 1*a* and 1*b* are installed in parallel, for example, one vertically above the other along a track (not illustrated), and the two signal lines 1*a* and 1*b* are divided, for example, into four sections of proper length in the direction of length of the track to form a first to fourth sections W1, W2, W3 and W4.

The terrain, e.g., factory floor, office floor, warehouse space over which the vehicle (not shown) is to travel is stationary and is hereafter called the "ground side". Located on the ground side, is a transmitting unit 2 incorporating a control power source (not illustrated) and a travelling sequence input/output unit 3 connected to this transmitting unit 2.

The transmitting unit 2 is provided with a plurality of sets of connecting terminals 2*a* and 2*b* corresponding to each section of the signal lines W1–W4. One of the terminals 2*a* is connected to the signal line 1*a* of each signal line section, and the other terminal 2*b* is connected to the signal line section 1*b*, and one of the signal lines 1*b* of each section is connected in series.

On the other hand, on the vehicle which receives signals from the ground side, a receiving unit 4 is located incorporating a control power source (not illustrated) and a travelling driving unit 5 which is connected to this receiving unit 4 and provides a power source for vehicle movement, a motor for moving the vehicle and the like are installed. The receiving unit 4 is provided with a set of collector connecting terminals 4*a* and 4*b*, having collectors 6*a* and 6*b* for sliding separately on the two signal lines 1*a* and 1*b*.

Figure 2:
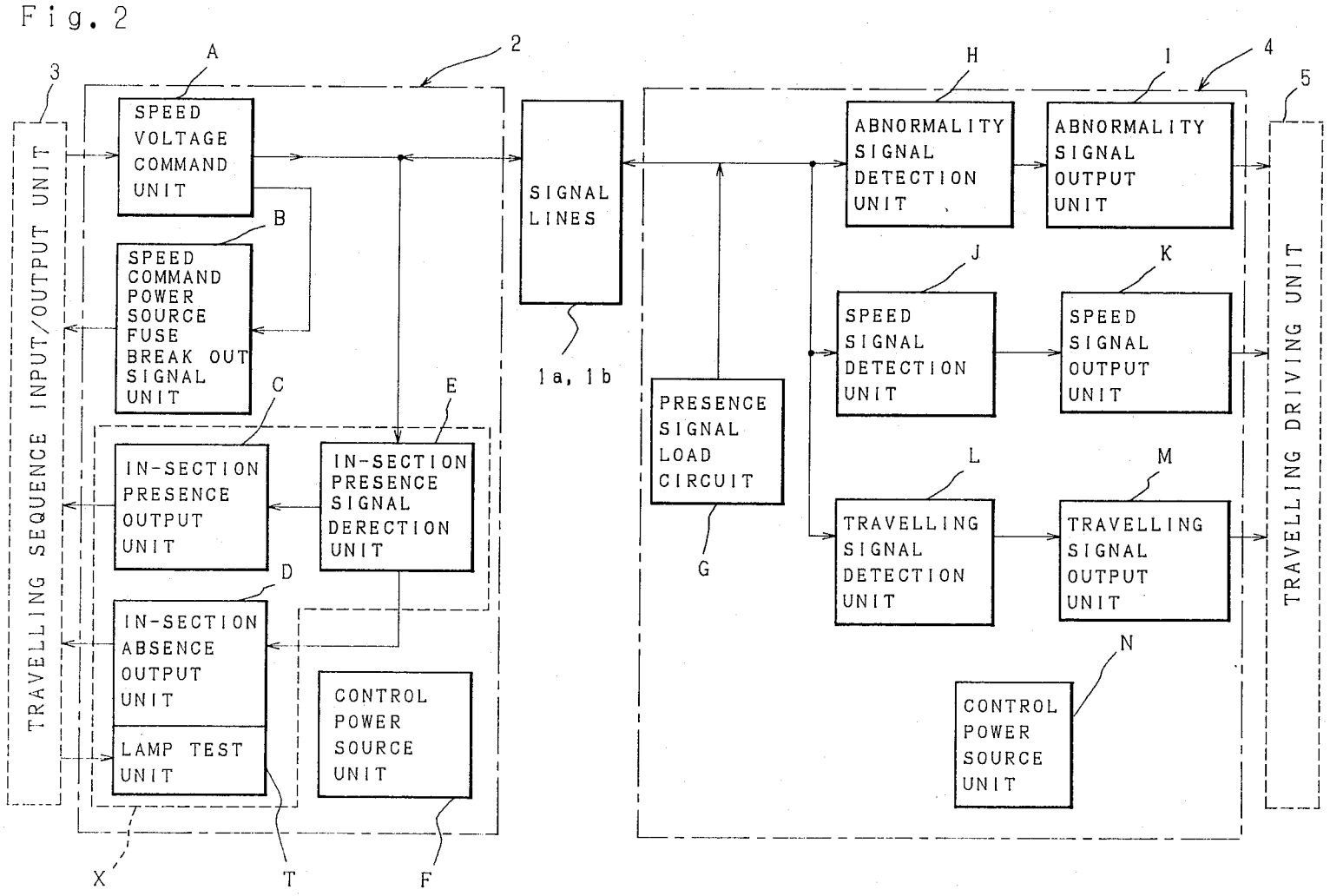
FIG. 2 is a block diagram showing a more detailed configuration of a vehicle travelling apparatus in accordance with the present invention.

FIG. 2 is a block diagram showing a more detailed configuration of a vehicle travelling apparatus in accordance with the present invention.

The transmitting unit 2 connected to the travelling sequence input/output unit 3 on the ground side has a speed command unit A for outputting speed command signals to control the speed at which the vehicle is to travel, that is, command speeds as D.C. voltages of different voltage levels corresponding to the commanded speeds. There is also a speed command power source fuse break out signal unit B for detecting a break of the speed command signal circuit and an in-section presence output unit C for outputting an output signal when detecting presence of a vehicle. Further, there is an in-section absence output unit D which comprises a lamp test unit and which outputs a signal when not detecting presence of a vehicle, an in-section presence signal detection unit E for detecting presence of a vehicle, and a control power source unit F for supplying a voltage to each of these units.

In addition, the above-mentioned in-section absence output unit D and in-section presence signal detection unit E comprise a presence signal output unit X.

An output signal of the travelling sequence input-/output unit 3 is supplied as an input to the speed voltage command unit A, and an output signal of the speed voltage command unit A is fed to the signal lines 1*a* and 1*b* and the speed command power source fuse break out signal unit B. An output signal of the speed command power source fuse break out signal unit B is fed to the travelling sequence input/output unit 3.

An in-section presence signal given from the signal lines 1*a* and 1*b* is inputted to the in-section presence signal detection unit E, and an output signal of this in-section presence signal detection unit E is inputted to the in-section presence output unit C and the in-section absence output unit D.

Respective output signals of the in-section presence output unit C and the in-section absence output unit D are inputted to the travelling sequence input/output unit 3. A voltage from the control power source unit F is supplied to each of these units.

Also, a signal from the travelling sequence input/output unit 3 is supplied to a lamp test unit T installed in the insection absence output unit D.

The receiving unit 4 connected to the travelling driving unit 5 on the vehicle has a presence signal load circuit G for causing a cirrent to flow between the signal lines of the section wherein the vehicle is present. It also has an abnormality signal detection unit H for detecting an abnormality of the control signal and an abnormality signal output unit 1 for outputting a signal corresponding to an abnormality of the control signal to the travelling driving unit. The receiving unit 4 further has a speed signal detection unit J for discriminating and detecting the command speed from the speed command signal supplied from the ground side and a speed signal output unit K for outputting a signal corresponding to the detected speed command signal to the travelling driving unit 5. There further is a travelling signal detection unit L for detecting presence or absence of the speed command signal, a travelling signal output unit M for outputting a signal indicating presence or absence of the detected speed command signal to the travelling driving unit 5, and a control power source unit N for supplying a voltage to each of those units.

The speed command signal provided to the signal lines 1*a* and 1*b* from the ground side is inputted to the speed signal detection unit J and the travelling signal detection unit L of the receiver 4 on the vehicle.

A presence signal from the presence signal load circuit G is supplied to the signal lines 1*a* and 1*b*.

An output signal of the abnormality signal detection unit H is inputted to the abnormality signal output unit I, and an output signal of the abnormality signal output unit I is inputted to the travelling driving unit 5.

Respective output signals of the speed signal detection unit J and the travelling signal detection unit L are inputted separately to the speed signal output unit K and the travelling signal output unit M. Respective output signals of the speed signal output unit K and the travelling signal output unit M are inputted to the travelling driving unit 5.

A voltage from the control power source unit N is supplied to each of these units.

Figure 3:
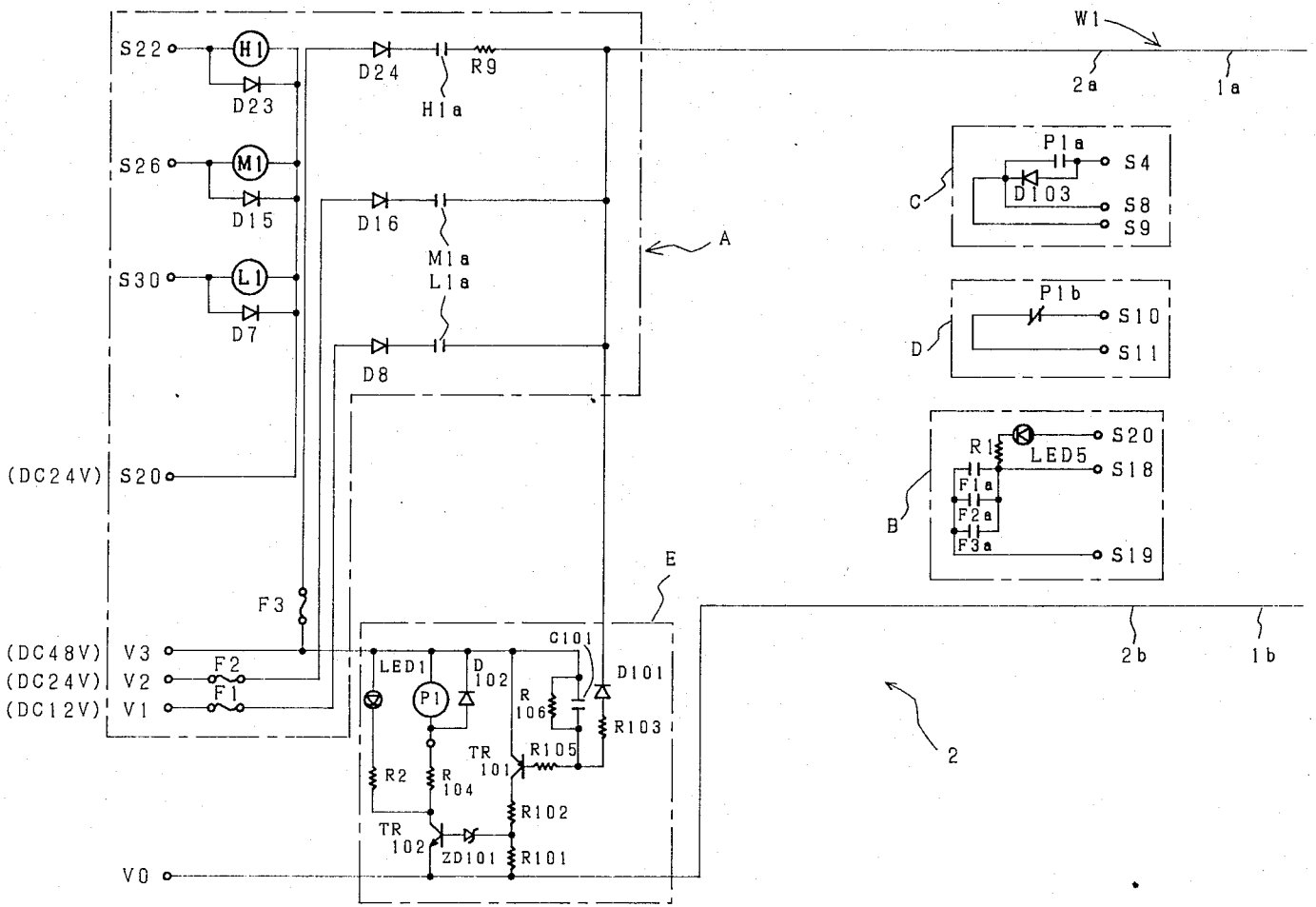
FIG. 3 is a circuit diagram showing one section of a transmitting unit.

FIG. 3 is a circuit diagram of the transmitting unit 2 connected to the first section W1 of the signal lines.

Terminals, S22, S26, S30 and S20 of the speed command unit A are connected to the above-mentioned travelling sequence input/output unit 3. A D.C. voltage of 24 V of a relay power source (not illustrated) is provided to these terminals S22, S26, and S30 from the terminal S20 which is connected to the positive electrode terminal of the relay power source.

A relay coil H1 of a high speed command relay for the first signal line section W1 has one end connected to terminal S22 and the other end to terminal S20 and a diode D23 connected in parallel between the terminals S22 and S20. A relay coil M1 of a medium speed command relay for the first signal line section W1 is connected between the terminals S26 and S20, and has a parallel connected diode D15. There is also a relay coil L1 of a low speed command relay for the first section W1 connected between the terminals S30 and S20 with a parallel connected diode D7.

Terminals V3, V2 and V1 are connected to the positive electrode terminal of a speed command signal power source (not illustrated) in the above-mentioned travelling sequence input/output unit 3, and a terminal V0 is connected to the negative electrode terminal of that power source. For example, a voltage of 48 V DC is available between the terminal V0 and the terminal V3, a voltage of 24 V DC is available between the terminal V0 and the terminal V2, and a voltage of 12 V DC available between the terminal V0 and the terminal V1.

Also, the negative electrode terminal of the relay power source having the above-mentioned terminal S20 is connected in common to the terminal V0.

The terminal V3 is connected to the first signal line section W1 through a series circuit of a fuse F3, a diode D24 whose anode is at the fuse F3 side, a normally opened contact H1*a* of the high speed command relay H1 for the first section W1 and a resistor R9.

The terminal V2 is connected to the signal line 1*a* of the first signal line section W1 through a series circuit of a fuse F2, a diode D16 whose anode is at the fuse F2 side, and a normally opened contact M1*a* of the medium speed command relay M1 for the first section W1. The terminal V1 is connected to the signal line 1*a* of the first section W1 through a series circuit of a fuse F1, a diode D8 whose anode is at the fuse F1 side and a normally opened contact L1*a* of the low speed command relay L1 for the first section W1.

The terminal V0, being the negative electrode terminal of the speed command signal power source, is connected to the other signal line 1*b* of the first section W1.

In the in-section presence detection unit E, a series circuit of a relay coil P1 of a presence relay for the first section W1, a resistor R104 and a transistor TR102 is connected between the terminals V3 and V0 with the emitter of the transistor TR102 at the terminal V0 side.

A diode D102 is connected in parallel to the relay coil P1 of the presence relay for the first section W1 with the cathode thereof at the terminal V3 side. There is also a series circuit of a light emitting diode LED1, whose anode is at the terminal V3 side, and a resistor R2 is connected in parallel to a series circuit of the relay coil P1 of the presence relay for the first section W1 and the resistor R104 which is a voltage dividing resistor for dropping the 48 V supply voltage from V3 to 24 V.

The light emitting diode LED1 lights when the relay coil P1 of the presence relay for the first section W1*b* is energized.

Furthermore, a series circuit of a resistor R102 and a resistor R101 is connected between the terminals V3 and V0 with the emitter of the transistor TR101 at the terminal V3 side. The junction of the resistors R102 and R101 is connected to the base of the above-mentioned transistor TR102 through a zener diode ZD101 whose cathode is connected to that junction. The zener diode ZD101 is employed for improving the threshold voltage (for eliminating noise).

A parallel circuit of a resistor R106 and a capacitor C101 is connected in series to a resistor R105 between the terminal V3 and the base of the transistor TR101. The capacitor C101 is for off-delay, and helps hold the current voltage for about 50 msec. even if the circuit is put in an instantaneous break due to poor connection between the collectors 6*a* and 6*b* and the signal lines 2*a* and 2*b* on the vehicle side.

The junction of the resistors R106 and R105 is connected to one of the signal lines 1*a* of the first section W1 through a series circuit of a resistor R103 and a diode D101 whose anode is at the resistor R103 side.

A normally opened contact P1*a* of the presence relay for the first section W1 is connected between terminals S4 and S8 of the in-section presence output unit C, and diode D103 is connected in parallel across the relay and between the terminals S4 and S9 with the anode thereof at the terminal S4 side. A presence detection output signal is outputted by closing the normally opened contact P1*a* of the presence relay for the first section W1.

A normally closed contact P1*b* of the presence relay for the first section W1 is connected between terminals S10 and S11 of the in-section absence output unit D, and an absence detection output signal is outputted by closing the normally closed contact P16. This means that the normally closed contacts P1*a* and P1*b* perform make and break operations opposite to each other when a presence signal is detected.

In the speed command power source fuse break out signal unit B, a series circuit of a light emitting diode LED5 and a resistor R1 is connected between the terminals S20 and S18. A parallel circuit of contacts F1*a*, F2*a* and F3*a*, which are closed by a break out of the fuses installed in the speed commanding unit A, is connected between the terminals S18 and S19.

Figure 4:
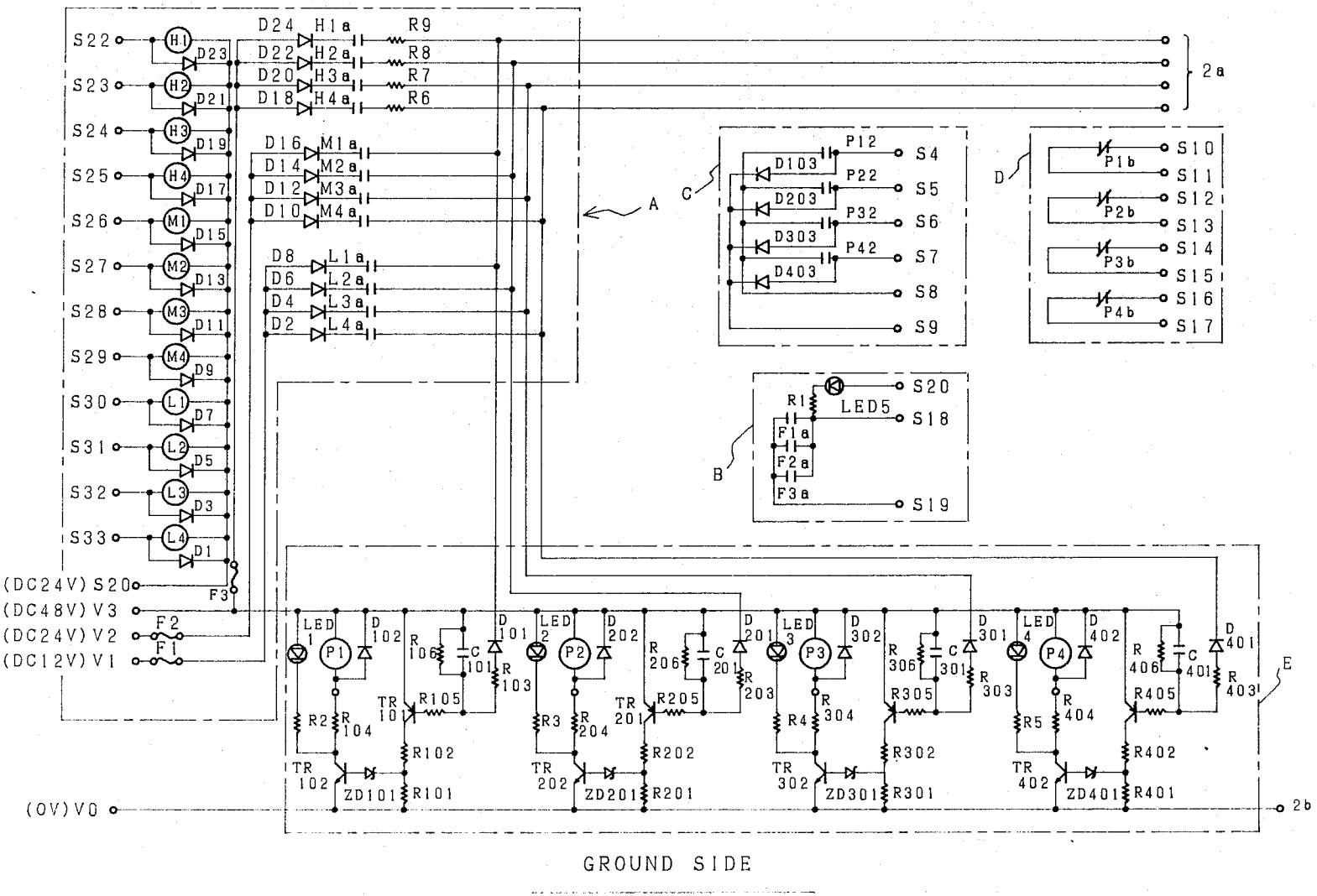
FIG. 4 is a circuit diagram showing additional details of a transmitting unit.

A transmitting unit 2 thus configurated as described above is installed likewise in each of the other three signal line sections, and FIG. 4 is an actual circuit diagram showing the combination of the transmitting unit of each of the four sections. The components of FIG. 3 designated by the number "1" for the first section are correspondingly designated 2, 3 and 4 for the other sections. The three digit reference numerals are 100, 200, 300, 400 series.

Figures 5A, 5B:
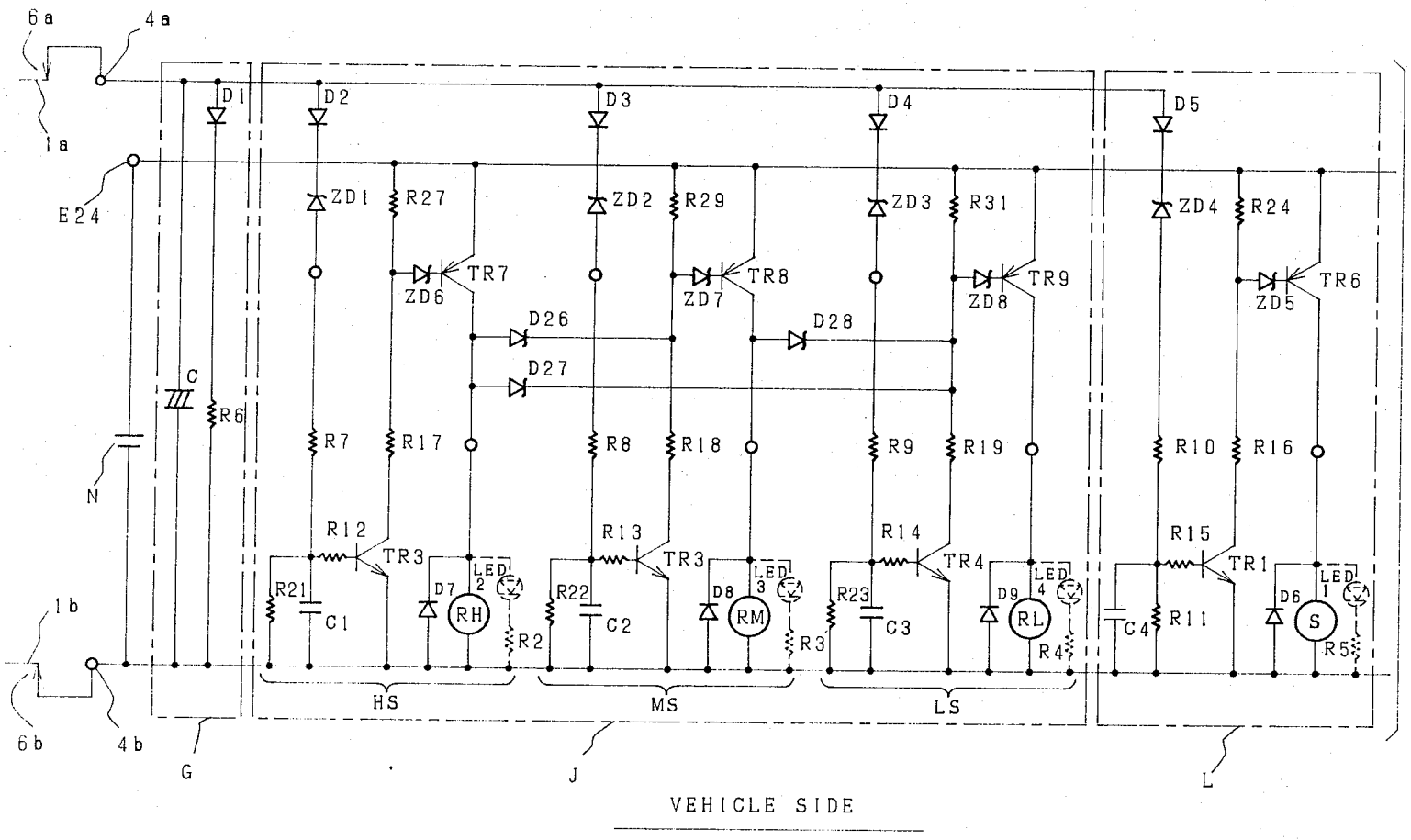
FIG. 5A and FIG. 5B are circuit diagrams showing a receiving unit for the vehicle.
Figure 5B:
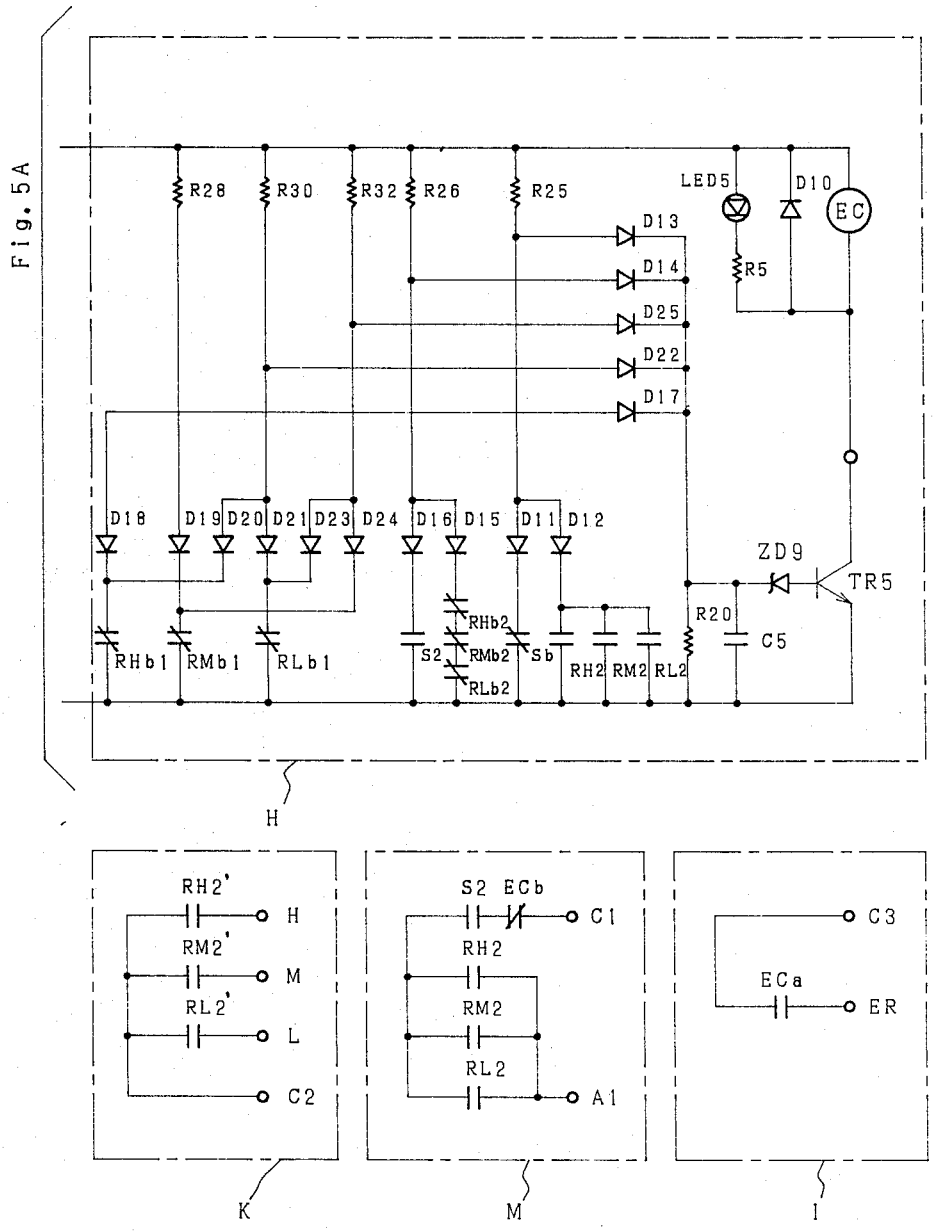

FIG. 5A and FIG. 5B are circuit diagrams showing a configuration of a receiving unit for the vehicle.

In the presence signal load circuit G (FIG. 5A), a series circuit of a diode D1 and a resistor R6 is connected between the collector connecting terminals 4*a* and 4*b* which are connected to the signal lines 1*a* and 1*b* through the collectors 6*a* and 6*b* (refer to FIG. 1). The anode of the diode D1 is at the collector connecting terminal 4*a* side, and a capacitor C is connected in parallel to this series circuit.

In the speed signal detection unit J, a series circuit of a diode D2, whose anode is at the connecting terminal 4*a* side, a zener diode ZD1 connected in anti-series to the diode D2, a resistor R7 and a capacitor C1 is connected between the collector connecting terminals 4*a* and 4*b*. A resistor R21 is connected in parallel to the capacitor C1.

A series circuit of a resistor R27, a resistor R17 and a transistor TR2 is connected between a positive electrode terminal E24 of the control power source unit N whose D.C. voltage is 24 V (refer to FIG. 1) and the collector connecting terminal 4*b*. The negative electrode of the power source unit E24 is connected to the emitter of the transistor TR2 on the collector connecting terminal 4*b* side. A series circuit of a transistor TR7, whose emitter is at the positive terminal E24 side, and a relay coil RH of a high speed drive relay is connected in parallel to that series circuit.

A diode D7, whose anode is at the collector connecting terminal 4*b* side, and a series circuit of a light emitting diode LED2, whose anode is at the collector side of the transistor TR7, and the resistor R2 are connected in parallel to the relay coil RH of the high speed drive relay, respectively. A zener diode ZD6 is connected between the base of the transistor TR7 and the junction of the above-mentioned resistors R27 and R17 with the cathode thereof at the base side of TR7, and thereby a high speed drive circuit HS is formed.

Also, a series circuit of a diode D3, whose anode is at the collector connecting terminal 4*a* side, a zener diode ZD connected in anti-series connection to the diode D3, a resistor R8 and a capacitor C2 is connected between the collector connecting terminals 4*a* and 4*b*. A resistor R22 is connected in parallel to the capacitor C2.

A series circuit of a resistor R29, a resistor R18 and a transistor TR3 is connected between the above-mentioned positive electrode terminal E24 and the collector connecting terminal 4*b* with the emitter of the transistor TR3 at the collector connecting terminal 4*b* side. There is also a series circuit of a transistor TR8, whose emitter is at the positive electrode terminal E24 side, and a relay coil RM of a medium drive relay connected in parallel to that series circuit.

A diode D8, whose anode is at the collector connecting terminal 4*b* side, and a series circuit of a light emitting diode LED3, whose anode is at the collector side of the transistor TR8, and a resistor R3 are each connected in parallel to the relay coil RM of the medium drive relay, respectively. Then, a zener diode ZD7 is connected between the base of the transistor TR8 and the junction of the above-mentioned resistors R29 and R18 with the cathode thereof at the base side of the transistor TR8, and thereby a medium speed drive circuit MS is formed. Furthermore, a series circuit of a diode D4 whose anode is at the collector connecting terminal 4*a* side, a zener diode ZD3 connected in anti-series connection to the diode D4, the resistor R9 and a capacitor C3 is connected between the collector connecting terminals 4*a* and 4*b*. A resistor R23 is connected in parallel to the capacitor C3.

A series circuit of a resistor R31, a resistor R19 and a transistor TR4 is connected between the above-mentioned positive electrode terminal E24 and the collector connecting terminal 4*b*, with the emitter of the transistor TR4 at the collector connecting terminal 4*b* side. There is also a series circuit of a transistor TR9 whose emitter is at the above-mentioned positive electrode terminal E24 side and a relay coil RL of a low speed drive relay is connected in parallel to that series circuit.

A diode D9, whose anode is at the collector connecting terminal 4*b* side, and a series circuit of a light emitting diode LED4, whose anode is at the collector side of the transistor TR9, and a resistor R4 are connected in parallel to the relay coil RL of the low speed drive relay, respectively. A zener diode ZD8 is connected between the base of the transistor TR9 and the junction of the above-mentioned resistor R31 and resistor 19 with the cathode at the base side of the transistor R19, and thereby a low speed drive circuit LS is formed.

In addition, in these high, medium and low speed drive circuits HS, MS and LS, diodes D26 and D27 for interlocking, whose anodes are at the collector side of the transistor TR7, are connected between the collector of the transistor TR7 of the high speed drive circuit HS and each of the collector of the transistor TR3 of the medium speed drive circuit MS and the collector of the transistor TR4 of the low speed drive circuit LS.

Also, a diode D28 for interlocking, with the anode at the collector side of the transistor TR8, is connected between the collector of a transistor TR8 of the medium speed drive circuit MS and the collector of the transistor TR4 of the low speed drive circuit LS. By the connections of these diodes D26, D27 and D28 for interlocking, the high, medium and low speed drive circuits HS, MS and LS are alternatively operated.

In addition, the above-mentioned capacitors C1, C2 and C3 are for off-delay, and function to continue the current operating state even in the case where the speed command signal is instantaneously broken. They also function to continue the operation even in changing-over the speed command signal.

In the travelling signal detection unit L of FIG. 5A, a series circuit of a diode D5, whose anode is at the collector connecting terminal 4*a* side, a zener diode ZD4 connected in anti-series connection to the diode D5, a resistor R10 and a resistor R11 is connected between the collector connecting terminals 4*a* and 4*b*. A capacitor C4 is connected in parallel to the resistor R11. A series circuit of a resistor R24, a resistor R16 and the transistor TR1 is connected between the positive electrode terminal E24 of the control power source unit N and the collector connecting terminal 4*b* with the emitter of the transistor TR1 at the collector connecting terminal 4*b* side. A series circuit of a transistor TR6, whose emitter is at the positive electrode terminal E24 side, and a relay coil S of a travelling signal relay is connected in parallel to that series circuit.

A diode D6 whose anode is at the collector connecting terminal 4*b* side and a series circuit of the light emitting diode LED1, whose anode is at the collector side of transistor TR6, and a resistor R5 are connected in parallel to the relay coil S of this travelling signal relay, respectively. Also, a resistor R15 is connected between the base of the above-mentioned transistor TR1 and the junction of the above-mentioned resistors R10 and R11. Furthermore, a zener diode ZD5, whose cathode is at the base side of the transistor TR6 is connected between the base of the transistor TR6 and the junction of the above-mentioned resistor R24 and resistor R16, and thereby the travelling signal detection unit L is formed.

In the travelling signal output unit M, (See FIG. 5B) a parallel circuit of normally opened contacts RH2, RM2 and RL2 which are closed when the above-mentioned high speed, medium speed and low speed drive relays are excited, is connected in series to a series circuit of a normally closed contact ECb, which is closed when the abnormality, detection unit H detects an abnormality and a normally opened contact S2 of the travelling signal relay. Contact S2 is closed when the relay coil S of the above-mentioned travelling signal relay is excited between signal output terminals C1 and A1. Thus, the travelling signal detection unit L performs an operation of detecting a speed command signal, and outputs a travelling signal for commanding travelling of the vehicle in the case where the speed signal detection unit performs an operation of detecting any one of high speed, medium speed and high speed command signals.

Referring to the abnormality signal detection unit H in FIG. 5B, a series circuit of a resistor R28, a diode D19 whose anode is at the resistor R28 side and a normally closed contact RMb1, which is opened by excitation of the relay coil RM of the above-mentioned medium speed drive relay, is connected between the positive electrode terminal E24 of the control power source unit N in the abnormality signal detection unit H and the collector connecting terminal 4*b* to which the negative electrode terminal thereof is connected.

A series circuit of a diode D18, whose anode is connected to the anode of the diode D17 and a normally closed contact RHb1 which is opened by excitation of the relay coil RH of the above-mentioned high speed drive relay, is connected in parallel to a series circuit of the diode D19 and the normally closed contact RMb1.

Also, a series circuit of a resistor R30, a diode D21 whose anode is at the resistor R30 side and a normally closed contact RLb1, which is opened by excitation of the relay coil RL of the above-mentioned low speed drive relay, is connected between the positive electrode terminal E24 and the collector connecting terminal 4*b*. The, anode of the diode D21 is connected to the cathode of the above-mentioned diode D18 through a diode D20 whose anode is connected to the anode of the diode D21.

A series circuit of a resistor R32 and a diode D23 is connected in parallel to a series circuit of a resistor R30 and the diode D21. The anode of the diode D23 is connected to the cathode of the above-mentioned diode D19 through the diode D24 whose anode is connected to the anode of the diode D23.

Furthermore, a series circuit of a resistor R26, a diode D16 whose anode is at the resistor R26 side, and the normally opened contact Sa which is closed by excitation of the relay coil S of the above-mentioned travelling signal relay, is connected between the positive electrode terminal E24 and the collector connecting terminal 4*b*. A series circuit of the diode D15 whose anode is connected to the anode of the diode 16 and normally closed contacts RHb2, RMb2 and RLb2, which are opened by excitation of the relay coils RH, RM and RL of the above-mentioned high speed, medium speed an low speed drive relays RH, RM and RL, is connected in parallel to a series circuit of the diode D16 and the normally opened contact Sa.

Furthermore, a series circuit of a resistor R25, a diode D11 whose anode is at the resistor R25 side, and a normally closed contact Sb which is closed by excitation of the relay coil S of the above-mentioned travelling signal relay, is connected between the positive electrode terminal E24 and the collector connection terminal 4*b*. A series circuit of the diode D12 whose anode is connected to the anode of the diode D11 and a normally opened contact RHa2 which is closed by excitation of the relay coil RH of the high speed drive relay is connected in parallel to a series circuit of the diode D11 and the normally closed contact Sb. The normally opened contacts RMa2 and RLa2, which are closed by excitation of the relay coils RM and RL of the medium speed and low speed drive relays, are connected in parallel to the normally opened contact RHa2, respectively.

The anodes of the above-mentioned diodes D11, D16, D24, D21 and D19 are connected to diodes D13, d14, D25, D22 and D27 whose cathodes are connected in common, respectively, and are connected to the collector connecting terminal 4*b* through a resistor R20. They are also being connected to the base of a transistor TR5 through a zener diode ZD9 whose cathode is at the resistor 20 side.

A relay coil EC of an abnormality signal relay is connected between the positive electrode terminal E24 and the collector of transistor TR5. A diode D10 whose anode is at the collector side of the transistor TR5 and a series circuit of at light emitting diode LED5 and a resistor R5 are connected in parallel to the relay coil EC, respectively. The emitter of the transmitter TR5 is connected to terminal 4*b*.

In the abnormality signal output unit I (FIG. 5B), a normally opened contact ECa, which is closed by excitation of the abnormality signal relay EC is connected between signal output terminals C3 and ER. Then, these signal output terminals C3 and ER are connected to a circuit (not illustrated) for stopping the vehicle by inhibiting control by the travelling driving unit 5.

A speed signal output unit K (FIG. 5B) encompassed by a dash-dot line is also provided on the receiving unit 4 of the vehicle.

Next, description is made on travelling controlling operation of the vehicle travelling apparatus in accordance with the present invention in the first section W1 in reference to FIGS. 3, 5A, 5B and 6.

In the vehicle travelling apparatus, as described above (See FIG. 1), the signal line connecting terminals 2*a* and 2*b* of the transmitting unit 2 of the ground side are connected to the signal lines 1*a* and 1*b* of the first section W1. In the case where a vehicle is present in the first section W1, the collector connecting terminals 4*a* and 4*b* of the receiving unit 4 of the vehicle are connected to the signal lines 1*a* and 1*b* of the first section W1 through the collectors 6*a* and 6*b*.

When (See FIG. 3) the relay coil L1 of the lfow speed command relay for the first section W1 is excited by applying a voltage between the terminals S30 and S20 of the transmitting unit 2 of the ground side to cause the vehicle to travel at a low speed, the normally opened contact L1*a* of the low speed command relay for the first section W1 is closed, and a D.C. voltage of 12 V between the terminals V1 and V0 is applied (See FIG. 5A) between the signal lines 1*a* and 1*b* as a speed command signal. This voltage is applied between the collector connecting terminals 4*a* and 4*b* of the receiving unit 4 of the vehicle side. The zener diode ZD3 having a zener voltage lower than the 12 V conducts a current, which flows in a sequence of the diode D4, the zener diode ZD3, the resistor R9 and the capacitor C3. The capacitor C3 is charged, so that the terminal voltage thereof rises, and the transistor TR4 is put in the conductive state. Due to this conductive state of the transistor TR4, the transistor TR9 conducts a current, which flows through the relay coil RL of the low speed drive relay to energize it, so that the low speed drive circuit LS is operated.

Also, the zener diode ZD4 having a zener voltage lower than 12 V is put in the conductive state in parallel with above-mentioned operation, and a current flows in a sequence of the diode D5, the zener diode ZD4, the resistor R10 and the capacitor C4, and the capacitor C4 is charged, so that terminal voltage thereof rises, and the transistor TR1 conducts. Due to the conductive state of the transistor TR1, the transistor TR6 conducts, the relay coil S of the travelling signal relay is excited, so that the travelling signal detection unit L is operated.

Thus, both the normally opened contacts RL2' and RL2 of the low speed drive relays located in the speed signal output unit K and the travelling signal output unit M (See FIG. 5B) are closed by excitation of the relay coil RL of the low speed drive relay, and the normally opened contact S2 of the travelling signal relay located in the travelling signal output unit M is closed by excitation of the relay coil S of the travelling signal relay.

Accordingly, the circuit is closed between the signal output terminals C1 and A1 of the travelling signal output unit M. This causes a signal for commanding travelling to be outputted through the travelling signal output unit M. Accordingly, a drive voltage as a signal corresponding to the speed command signal is applied to a motor (not shown) on the vehicle for controlling its travelling by the speed signal output unit K, and the motor is caused to be rotated at a low speed, and the vehicle travels at a low speed.

In the case where both the speed signal detection unit J and the travelling signal detection unit L (See FIG. 5A) do not detect a speed command signal, the vehicle does not move, even assuming that a wrong detection has been made. Even when the speed signal detection unit J operates as if it has detected a speed command signal, such as due to a pulse caused by external noise entering into the speed signal detection unit J on the like, the state that the vehicle is to move or is to stop cannot take place when the travelling signal detection unit L does not detect a speed command signal. Thus, the reliability of travelling vehicle is enhanced.

In the case where the vehicle is to travel at a medium speed, the speed command signal for low speed travelling is stopped and a voltage is applied between the terminals S26 and S20 of the receiving unit 4 (See FIG. 3) to excite the relay coil M1 of the medium speed command relay for the first section W1. Thus, the normally opened contact M1*a* is closed and a D.C. voltage of 24 V is applied between the terminals V2 and V0 as a speed command signal across the signal lines 1*a* and 1*b*. In the receiving unit 4 (See FIG. 5A), the zener diode ZD2 having a zener voltage greater than 12 V but lower than 24 V conducts and the medium speed drive circuit MS is operated like the low speed drive circuit LS. That is, capacitor C2 charges to a voltage at which transistor TR3 becomes conductive. This causes transistor TR8 to conduct, which in turn energizes relay RM. At this time, the low speed circuit LS zener diode ZD3 also conducts, but when the medium speed drive circuit MS is operated the operation of the low speed drive circuit LS is inhibited by the diode D28 which, when transistor TR8 is conductive applies a voltage to transistor TR9 to make it non-conductive.

In the case where the speed command signal is given to make such a medium-speed travelling, the travelling signal detection unit L also detects the medium speed command signal. Like as described above, the normally opened contact Sa of the travelling signal output unit M is closed as relay S is energized. Also, the relay coil RM of the medium speed command relay of the speed signal detection unit J is energized, so that the normally opened contact RMa thereof is closed, and therefore the travelling signal is outputted to the motor. Consequently, a driving voltage corresponding to the speed command signal is applied to the motor for travelling by operation of the medium speed drive circuit MS, and the motor is rotated at a medium speed, so that the vehicle travels at a medium-speed. When high-speed travelling of the vehicle is desired, a voltage is applied between the terminals S22 and S20 of the transmitting unit 2. This causes the relay coil H1 of the high speed command relay for the first section W1 to be energized. The high speed drive circuit HS of the receiving unit 4 is operated in a manner similar to that previously described to cause the vehicle to travel. That is, 48 V DC is applied across terminals 4*a*, 4*b* causing zener diode ZD1 to conduct, charging capacitor C1 and turning on transistor TR3. This causes transistor TR7 to be turned on to a conductive state through zener diode ZD6, thereby energizing high speed relay RH and opening and closing the respective contacts associated with it. When transistor TR7 conducts, voltages applied through zener diodes D26 and D27 make transistors TR8 and TR9 non-conductive so that relays RM and RL are not energized. The high speed command signal is applied to the vehicle motor so that the vehicle will travel at a high speed.

This means that the travelling speed of the vehicle can be controlled by applying the speed command signals whose voltage levels are changed-over between the two signal lines 1*a* and 1*b*.

When a high speed control is made and no abnormal conditions exist, both the normally closed contacts RHb1 and RHb2 in the abnormality signal detection unit H (See FIG. 5B) are opened, the normally open contact RHa2 is closed. This causes the base voltage of the transistor TR5 to drop and the transistor TR5 is put in the non-conductive state so that the relay coil EC of the abnormality signal relay is not excited. Thus, the normally opened contact ECa of the abnormality signal output unit I is left in the opened state, and the abnormality signal detection unit H does not detect an abnormality of the controlling operation. However, for example, when the relay coils RH and RM of the high speed and medium speed relays are both excited due to a wrong detection of the speed signal detection unit J on the like, the normally closed contacts RHb1, RHb2, RMb1 and RMb2 in the abnormality signal detection unit H are opened together the normally opened contacts RHa2 and RMa2 are both closed, so that the base voltage of the transistor TR5 rises. Consequently, the transistor Tr5 conducts to energize the relay coil EC of the abnormality signal relay, and the normally opened contact ECa in the abnormality signal output unit I is closed. Thus, the abnormality of the controlling operation is detected, the travelling control signal is inhibited, and the vehicle is stopped.

Apart from the above, in the case where the relay coil S of the travelling signal relay (FIG. 5A) is not excited, that is, where the speed command signal is not detected, when one of the relay coils RH, RM or RL, for example, the relay coil RH of the high speed drive relay is excited due to a malfunction, the normally closed contacts RHb1 and RHb2 in the abnormality signal detection unit H are opened, the normally opened contact RHa2 is closed, and the base voltage of the transistor TR5 rises. Then, as described above, the normally opened contact Eca in the abnormality signal output unit I is closed, so that an abnormality of the controlling operations is detected. Consequently, also in this case, trabelling control is inhibited, and the vehicle is stopped.

Furthermore, in the case where that the speed command signal is detected and the relay coil S of the travelling signal relay is excited, when two of the relay coils, RH, RM and RL, for example, the relay coils RH and RM are excited together, the normally opened contact Sa in the abnormality signal detection unit H is closed and the normally closed contact Sb is opened. Also, the normally closed contacts RHb1, RHb2, RMb1 and RMb2 are opened together, and the normally opened contacts RHa1 and RMa2 are closed. Consequently, the base voltage of the transistor TR5 rises, the normally opened contact ECa in the abnormality signal output unit I is closed. Thus, as described above, an abnormality of the controlling operation is detected, and in this case also, travelling control is inhibited and the vehicle is stopped.

Apart from travelling control signal detection, in the case where the vehicle is present in the first section W1, a series circuit (FIG. 5A) of the diode D1 and the resistor R6 of the presence signal load circuit G in the receiving unit 4 of the vehicle side exists between the signal lines 1*a* and 1*b*. Consequently, a current flows from the terminal V3 of the in-section presence signal detection unit E (FIG. 3) in the transmitting unit 2 to the terminal VO. The base of the transistor TR101 is forward biased through the resistor R105, the resistor R103, the diode D101, the signal line 1*a*, the diode D1 of the presence signal load circuit G, the resistor R6 and the signal line 1*b* in that sequence. Consequently, the transistor TR101 of the presence signal detection unit E conducts, the base voltage of the transistor TR102 rises, so that the transistor TR102 is put in the conductive state. By this conduction, the relay coil P1 of the presence relay for the first section W1 is excited, so that the light emitting diode LED1 for indicating the presence of a vehicle in section W1 is lit.

Also, by excitation of the relay coil P1 of the presence relay for the first section W1, the normally opened contact P1*a* of the presence relay installed in the in-section presence output unit C (see FIG. 3) is closed to output the signal of the presence of vehicle in the first section W1. Simultaneously the normally closed contact P1*b* of the presence relay in the in-section absence output unit D is opened, so that the signal outputted when the vehicle is absent in the first section W1 disappears. This signal of the in-section absence ouput unit D is used for inhibiting an entry of the vehicle into another section where a vehicle is present as described later. The control of the travelling speed and the detection of presence of the vehicle can be performed for each section by the detection circuits for the relays P2, P3 and P4.

Figure 6:
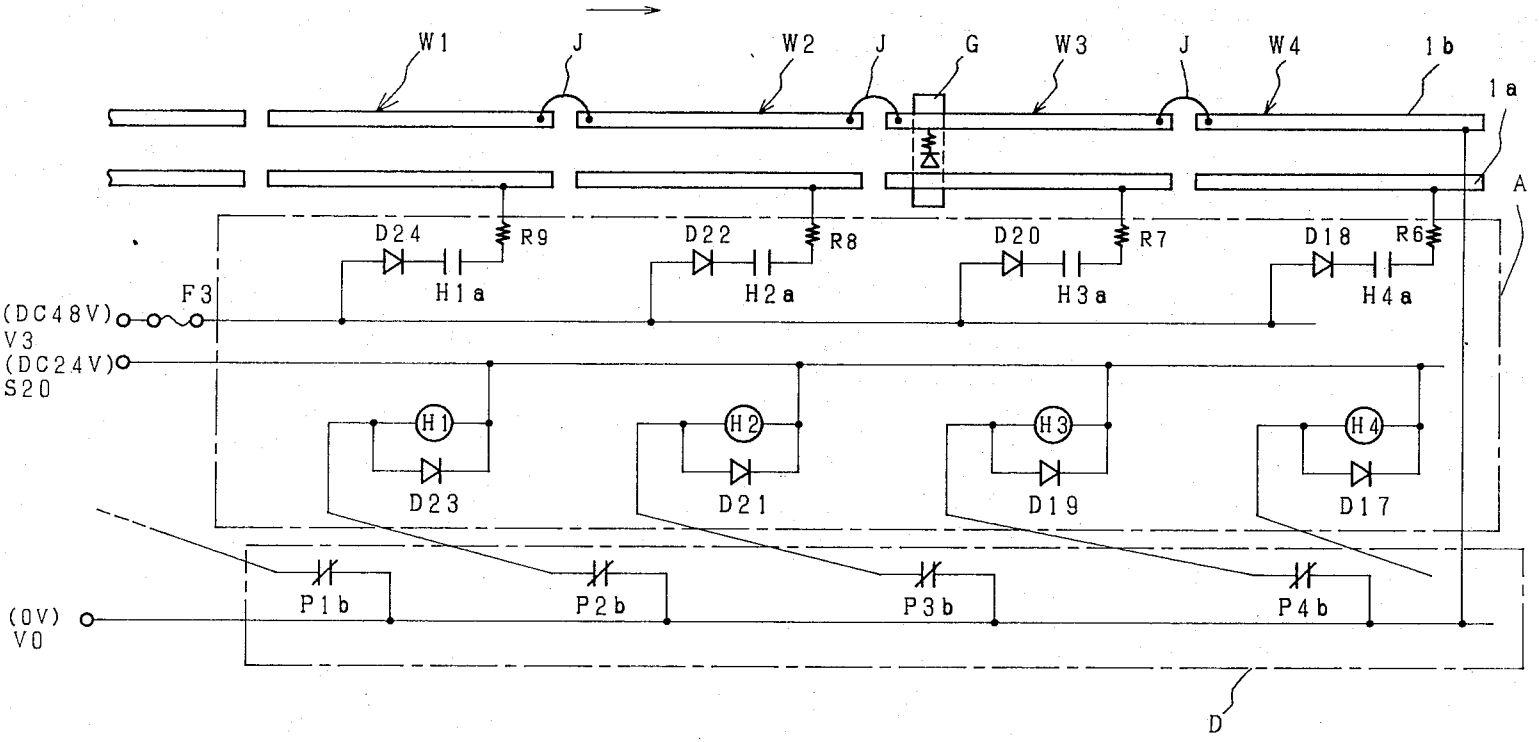
FIG. 6 is a circuit diagram showing connections of signal lines of a number of sections, a speed commanding unit and an insection presence output unit.

FIG. 6 is a schematic diagram showing the state of connections of the signal lines, the speed command units A and the in-section presence output unit C in the respective sections W1, W2, W3 and W4. For explanatory convenience, only the portions associated with the high speed command relay are shown.

The first through the fourth sections W1 through W4 are connected to the signal lines 1*a* and 1*b*. The terminal V3 of the transmitting unit 2 of the ground side (See FIG. 4 and FIG. 6) is connected: to the signal line 1*a* of the first section W1 through the fuse F3, the diode D24, the normally opened contact H1*a* of the high speed command relay for the first section W1 and the resistor R9; to the signal line 1*a* of the second section W2 through the fuse F3, the diode D22, the normally opened contact H2*a* of the high speed command relay for the second section W2 and the resistor R6; to the signal line 1*a* of the third section W3 through the fuse 3, the diode D20, the normally opened contact H3*a* of the high speed command relay for the third section W3 and the resistor R7; and to the signal line 1*a* of the fourth section W4 through the fuse F3, the diode D18, the normally opened contact H4*a* of the high speed command relay for the fourth section W4 and the resistor R8, respectively. Then, the other signal lines 1*b* of the respective sections are connected to one another by jumper wires J, being connected to the terminal VO of the receiving unit 2.

Further more, referring to FIG. 4: the relay coil H1 of the high speed command relay for the first section W1, to which the diode D23 is connected in parallel, is connected between the terminal S20 and the terminal S22; a relay coil H2 of the high speed command relay for the second section W2 to which the diode D21 is connected in parallel, is connected between the terminal S20 and the terminal S23; a relay coil H3 of the high speed command relay for the third section W3, to which the diode D19 is connected in parallel, is connected between the terminal S20 and the terminal S24; a relay coil H4 of the high speed command relay for the fourth section W4, to which the diode D17 is connected in parallel, is connected between the terminal S20 and the terminal S25, respectively. In this manner, the speed command unit A for high speed command is formed.

There is: a series circuit of the relay coil H1 of the high speed command relay for the first section W1, to which the diode D23 is connected in parallel, and a normally closed contact P1*b* of the presence relay P1 for the first section W1; a series circuit of the relay coil of the high speed command relay for the second section W2, to which the diode D21 is connected in parallel, and a normally closed contact P2*b* of a presence relay P3 for the second section W2; and a series circuit of the relay coil H3 of the high speed command relay to which the diode D19 is connected in parallel, and a normally closed contact P3*b* of the presence relay for the third section W3; and a series circuit of the relay coil of the high speed command relay for the fourth section W4, to which the diode D17 is connected in parallel, and a normally closed contact P4*b* of a presence relay P4, are connected respectively between the terminal S20 and the terminal V0.

The normally closed contact P1*b* of the presence relay for the first section W1 is connected between one terminal of the relay coil of the presence relay for the section (not illustrated) immediately preceding the first section W1 and the terminal V0 like the other normally closed contacts as described above.

A normally closed contact of the presence relay for the following section (not illustrated) for the section after the fourth section W4 is connected also between one end of the high speed command relay H4 for the fourth section W4 and the terminal V0. The in-section absense output unit D is constituted with these normally closed contacts P1*b*, P2*b*, *P3b* and P4*b*.

Next, description is made on controlling operation of inhibiting an entry of the vehicle into the vehicle-present section by a circuit as shown in FIG. 6.

A vehicle (not illustrated) is assumed to travel from the first section W1 side in the direction as shown by the arrow. In the case where a vehicle is not present in the following second section W2, the above-mentioned presence signal load circuit G of the vehicle side does not exist between the signal lines 1*a* and 1*b* of the second section W2. Therefore, no current flows between the signal lines 1*a* and 1*b*, and the relay coil P2 of the presence relay for the second section W2 of the in-section presence signal detection unit E of the ground side (refer to FIG. 4) is not excited. With relay P2 not excited, the normally closed contact P2*b* of the in-section absence output unit D is closed, so that relay coil H1 of the high speed command relay for the first section W1 is excited, and the normally opened contact H1*a* thereof is closed. Consequently, a D.C. voltage of 48 V can be applied between the terminal V3 and the terminal V0, that is, the high speed command signal is applied to the signal lines 1*a* and 1*b* of the first section W1 through the diode D24, the normally opened contact H1*a* and the resistor R9, so that the vehicle which enters into the first section W1 is driven by the speed command signal for commanding travel at a high-speed in the first section W1.

In the case where a vehicle is present in the third section W3, the presence signal load circuit G of such vehicle between the signal lines 1*a* and 1*b* of the third section W3 is energized. Thus a current flows between the signal lines 1*a* and 1*b*, and therefore the relay coil P3 of the presence relay for the third section W3 of the in-section presence signal detection unit E of the ground side (refer to FIG. 4) is excited, and a normally closed contact P3*b* thereof is opened. This means that the output signal of the in-section absence output unit D disappears, and the relay coil H2 of the high speed command relay for the second section W2 is de-energized, and the normally opened contact H2*a* thereof is opened. Consequently, the high speed command signal applied between the signal lines 1*a* and 1*b* of the second section W2 is cut off. Accordingly, the vehicle which enters from the first section W1 to the second section W2 stops in the second section W2, being inhibited to enter into the third section W3 because of the presence of the vehicle in section W3. Thereby, the vehicle which travels through the second section W2 does not collide against the vehicle present in the third section W3 from behind.

In addition, by connecting the relay coils M1, M2, M3, L1, L2 and L3 of the medium speed and low speed command relays for each section of the speed command unit A to the signal lines 1*a* and 1*b* of the respective sectons W1, W2, W3 and W4 in the same manner as the coils of the command relays for high speed, the presence or absence of a vehicle in a respective section can likewise be determined as in the medium speed and low speed the case of the high speed command.

Also, an entry of the vehicle into the vehicle-present section is inhibited also in performing the medium speed or low speed control.

In addition, in the preferred embodiment of the invention, the controlling operation using no travelling control sequence is shown, but a configuration providing functions such as selective command of the travelling speed, inter-section corresponding shift of travelling information, inter-section movement confirmation, monitoring and the like can be applied using the presence signal.

Also, in the preferred embodiment, although detailed description on the controlling operation is omitted, when the circuit for outputting the speed command signal of the speed commanding unit is opened by opening of a fuse, that state is detected by the speed command power source fuse failure signal unit B.

In this embodiment, the speed command signal is outputted in three steps of low, medium and high speeds, but it should be apparent that a speed control of a larger number of steps can be performed by further increasing the number of levels of voltages available and respective control signals therefore.

As detailed above, in accordance with the vehicle travelling apparatus of the present invention, in the case where two among the high, medium and low speed drive relays are operated together, or in the case where any one of the high, medium and low speed drive relays is operated when the travelling signal relay is not operated, or in the case of abnormal controlling operation such that two of the high, medium and low speed drive relays are operated when the travelling signal relay is operated, the abnormality signal detection unit detects such a state and inhibits the travelling of the vehicle. Therefore, there is no possibility that the vehicle travels by wrong control of the speed signal detection unit or the travelling signal detection unit. Accordingly, the vehicle travelling apparatus in accordance with the present invention further increases the reliability and provides a safer control of travelling.

Also, the vehicle travelling apparatus in accordance with the present invention employs a voltage signal as a signal for directing the speed of vehicle, and therefore the circuit configuration thereof is simplified.

Furthermore, the vehicle travelling apparatus in accordance with the present invention requires only a set of two signal lines, and therefore the economical performance is improved.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A vehicle travelling apparatus for starting, speed changing and stopping of a vehicle which travels relative to a track by means of a signal provided from the ground side, comprising;

at the ground side:

a set of signal lines which are disposed along said track, and are divided into a plurality of sections in the direction of length thereof, and mutually transmit or receive signals from the ground side or the vehicle side;

a speed command unit for producing a speed command signal whose voltage level varies corresponding to the command speed to said signal lines; and a presence signal output unit to detect the presence of a vehicle in each divided section of said signal lines and producing a signal corresponding thereto, and at the vehicle side:

a speed signal detection unit which reads said speed command signal from said signal line and discriminates the command speed to control the travelling speed of the vehicle; and a presence signal circuit for causing a current to flow between said signal lines to indicate the presence of a vehicle in each section.

2. A vehicle travelling apparatus as set forth in claim 1, wherein said presence signal output unit includes an off delay circuit.

3. A vehicle travelling apparatus as set forth in claim 1 wherein said speed signal detection unit includes an off delay circuit.

4. A vehicle travelling apparatus as set forth in claim 1, wherein said speed command unit directs the vehicle to travel at a higher speed by a higher voltage signal and at a lower speed by a lower voltage signal.

5. A vehicle travelling apparatus for starting, speed changing and stopping of a vehicle which travels relative to a track by means of a signal provided from the ground side, comprising;

at the ground side, a signal line disposed along said track for conveying signals;

a speed command unit outputting to said signal being a speed command signal whose voltage level varies corresponding to the command speed; and at the vehicle side;

a speed signal detection unit which reads said speed command signal from said signal line and discriminates the command speed to control the travelling speed of the vehicle, and a travelling signal detection unit which reads said speed command signal from said signal line and detects the presence of the signal;

whereby the vehicle travels according to said speed command signal in the case where both of said speed signal detection unit and travelling signal detection unit detect signals.

6. A vehicle travelling apparatus as set forth in claim 5, wherein said speed signal detection unit have an off delay circuit.

7. A vehicle travelling apparatus as set forth in claim 5, wherein said speed command unit directs the vehicle to travel at a higher speed by a higher voltage signal and at a lower speed by a lower voltage signal.

8. A vehicle travelling apparatus for starting, speed changing and stopping of a vehicle which travels relative to a track by means of a signal provided from the ground side, comprising;

at the ground side, a signal line disposed along said track for conveying signals, a speed command unit outputting to said signal line a speed command signal whose voltage level varies corresponding to the command speed to said signal lines; and at the vehicle side;

a speed signal detection unit which reads said speed command signal from said signal line and discriminates the command speed to control the travelling speed of the vehicle;

a travelling signal detection unit which reads said speed command signal from said signal line and detects the presence of the signal; and an abnormality signal detection unit for detecting an abnormal controlling operation of said speed signal detection unit or said travelling signal detection unit and operating to permit travels according to said speed command signal in the case where both of said speed signal detection unit and travelling signal detection unit detect signals and to stop the vehicle in the case where said abnormality signal detection unit detects an abnormal controlling operation.

9. A vehicle travelling apparatus as set forth in claim 8, wherein said speed signal detection unit has an off delay circuit.

10. A vehicle travelling apparatus as set forth in claim 8, wherein said speed command unit directs the vehicle to travel at a higher speed by a higher voltage signal and at a lower speed by a lower voltage signal.

* * * * *